United States Patent [19]

Matz et al.

[11] Patent Number: 4,826,043

[45] Date of Patent: May 2, 1989

[54] APPARATUS FOR METERING MATERIALS IN THE FORM OF PIECES

[75] Inventors: Ludwig Matz, Tornesch; Thomas Moest, Moorrege, both of Fed. Rep. of Germany

[73] Assignee: Nordmark Arzneimittel GmbH, Uetersen, Fed. Rep. of Germany

[21] Appl. No.: 66,996

[22] Filed: Jun. 29, 1987

[51] Int. Cl.[4] ..... B65D 83/04

[52] U.S. Cl. ..... 221/263; 206/540

[58] Field of Search ..... 221/263, 265, 186; 206/534, 540

[56] References Cited

U.S. PATENT DOCUMENTS

| | | | |
|---|---|---|---|
| 1,233,482 | 7/1917 | Kaletay | 222/158 |
| 3,446,403 | 5/1969 | Serio | 222/158 |
| 3,863,804 | 2/1975 | Infante-Diaz et al. | 221/263 X |
| 4,228,920 | 10/1980 | Burton | 221/265 |
| 4,489,834 | 12/1984 | Thackrey | 206/534 |
| 4,613,057 | 9/1986 | Sacchetti et al. | 221/265 |
| 4,705,182 | 11/1987 | Newel-Lewis | 206/534 X |

FOREIGN PATENT DOCUMENTS

| | | | |
|---|---|---|---|
| 0002403 | 6/1979 | European Pat. Off. . | . |
| 2822581 | 11/1979 | Fed. Rep. of Germany | 221/186 |
| 3335138 | 5/1984 | Fed. Rep. of Germany | . |
| 1385900 | 3/1975 | United Kingdom | 221/263 |

*Primary Examiner*—F. J. Bartuska

*Attorney, Agent, or Firm*—Keil & Weinkauf

[57] ABSTRACT

In an apparatus for removing portions of identical materials (4) in the form of pieces by means of a sliding part which is encased in a dispensing container and operated from the outside and whose dispensing sector (5) is filled from inside the container and can be emptied outward, the sliding part is in the form of a tube section (1) which has one or more dispensing sectors (5) and is fed through an outer shell (3) and a stripper (2) located adjacent to the ejection orifice (9) and assigned to the dispensing sectors (5).

1 Claim, 1 Drawing Sheet

APPARATUS FOR METERING MATERIALS IN THE FORM OF PIECES

The present invention relates to an apparatus for removing portions of identical materials in the form of pieces by means of a sliding part which is encased in a dispensing container and is operated from the outside and whose dispensing sector is filled from inside the container and can be emptied outward.

A dispensing can of the type stated at the outset is disclosed in German Laid-Open Application DOS No. 3,335,138. The can contains a movable sliding part which can be operated from outside the can by means of an actuating part and can assume two end positions. In the initial position, a channel present in the can is aligned with a dispensing sector in the movable sliding part. The round or square tablets thus pass through a funnel-shaped inlet and through the channel into the dispensing sector, which is preferably designed to accept one tablet.

If the sliding part is brought to its second end position against the force of a reset spring, the dispensing sector opens outward but at the same time is closed to the inside by the displacement of the sliding part, so that only the content of the dispensing sector is released. Although the known dispensing can permits one tablet to be dispensed in each case without shaking being necessary, dispensing a certain number of tablets with this apparatus is possible only by accurately operating the sliding part a number of times correspnding to the number of tablets. Where large numbers are involved, counting errors and incomplete operation can easily occur, which, for example when highly active substances are being metered, is completely unacceptable.

It is an object of the present invention to provide an apparatus for removing portions of identical materials in the form of pieces, which permits a predetermined number of pieces of the said material to be metered reliably and in a simple manner, and in which the same amount can be removed repeatedly in a simple manner.

We have found that this object is achieved, according to the invention, if the sliding part of the apparatus stated at the outset is in the form of a tube section which has one or more dispensing sectors and is fed through an outer shell and a stripper located adjacent to the ejection orifice and assigned to the dispensing sectors. Subclaims 2, 3 and 4 relate to advantageous embodiments of the invention.

Using this apparatus, it is possible to meter materials in the form of pieces in conformity with the individual requirements and in variable, freely selectable numbers, and to check the amount removed with reference to markings of simple form. Different concentrations of active compound in the said materials are no longer necessary; they can be achieved by changing the number of pieces of the said material which are metered.

The invention is illustrated below with reference to FIGS. 1 to 3.

Figure 1:
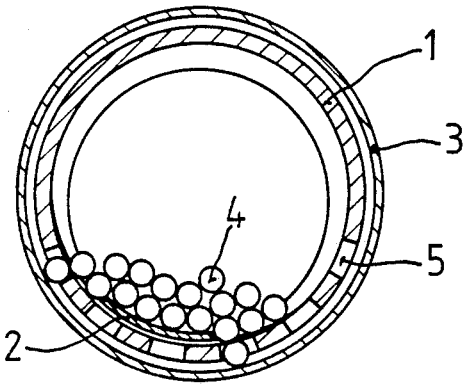
FIG. 1 shows a cross-section through the novel metering apparatus.
Figure 2:
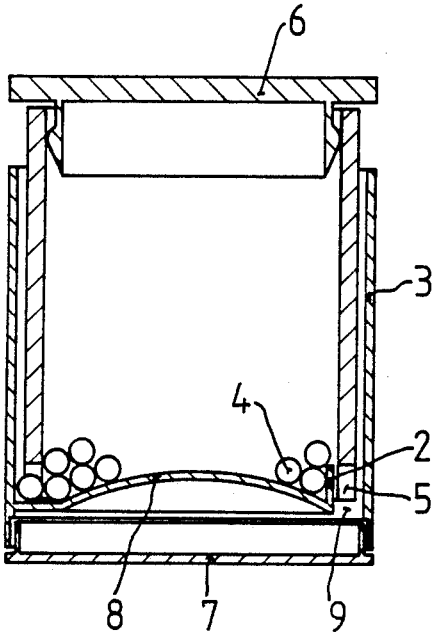
FIG. 2 shows a longitudinal section through the metering apparatus.
Figure 3:
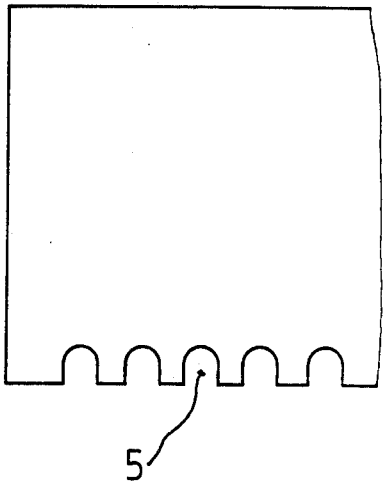
FIG. 3 shows the unwound tube section, with a possible embodiment of the dispensing sectors for the materials in the form of pieces.

A dispensing container contains identical materials 4 in the form of pieces. A tube section 1, which in turn has dispensing sectors 5 for the said materials 4, is arranged between the outer shell 3 and the stripper 2 of the dispensing container.

The dispensing sectors 5 are filled from the inside of the dispensing container, in the region not covered by the stripper 2, via which the materials 4 in the form of pieces enter the dispensing sector 5 of the tube section 1.

When the tube section 1 is rotated by an actuating means 6, the particular charged dispensing sector 5 is separated from the inside of the dispensing container by the stripper 2 and conveyed to the ejection orifice 9 in the base 8 of the outer shell 3 of the dispensing container.

The ejection orifice 9 can be covered, for example, by a lid 7, in the form of a collecting container. The actuating means 6 serves as a closure for the interior of the dispensing container. The markings for the amounts dispensed are applied to the tube section 1 so that they are visible from outside.

We claim:

1. Apparatus for removing portions of identical materials (4) in the form of pieces by means of a sliding part which is encased in a dispensing container and operated by an upper closure actuating means (6) from the outside and whose dispensing sector (5) is filled from inside the container and can be emptied outward, wherein the sliding part is in the form of a tube section (1) which has a predetermined number of dispensing sectors (5) and is fed through an outer shell (3) and a stripper (2) located adjacent to the lower ejection orifice (9) and assigned to the dispensing sectors (5), wherein the base (8) of the outer shell (3) is dome-shaped and a lid (7) for receiving the dispensed materials (4) in the form of pieces is fastened to the lower part of the outer shell (3).

* * * * *